United States Patent [19]

Angelini

[11] 3,986,657

[45] Oct. 19, 1976

[54] MULTI-CORNERED BOX

[75] Inventor: Carl A. Angelini, Lambertville, N.J.

[73] Assignee: Trent Box Manufacturing Company, Inc., Hamilton Square, N.J.

[22] Filed: Sept. 12, 1975

[21] Appl. No.: 612,872

[52] U.S. Cl. ..... 229/32; 229/23 BT; 206/424

[51] Int. Cl.[2] ..... B65D 5/28

[58] Field of Search ..... 229/32, 23 BT, 40, 37 E; 206/424, 521

[56] References Cited

UNITED STATES PATENTS

| | | | |
|---|---|---|---|
| 1,876,200 | 9/1932 | Brown et al. | 229/32 |
| 1,877,213 | 9/1932 | Willauer | 229/32 UX |
| 2,597,289 | 5/1952 | Casky | 229/32 |
| 3,237,838 | 3/1966 | Elias | 229/23 BT |
| 3,520,466 | 7/1970 | Vokes et al. | 229/32 |
| 3,829,004 | 8/1974 | Graser | 229/32 |

*Primary Examiner*—Davis T. Moorhead
*Attorney, Agent, or Firm*—Sperry and Zoda

[57] ABSTRACT

A one-piece rectangular box having double reinforced corners at opposite ends thereof is formed from a single rectangular sheet of material having opposite end portions provided with sections which are doubled and folded inward and secured in overlying relation with respect to the central base portion of the sheet. The double portions extend upward from the inwardly folded sections to form reinforced end walls of the box. Side portions of the sheet extend upward from the base portions to hold the ends and sides of the box in place eliminating the need for dunnage or packing and cushioning means for protecting corners of the box and its contents.

5 Claims, 4 Drawing Figures

MULTI-CORNERED BOX

BACKGROUND OF THE INVENTION

1. Field of Invention

Boxes formed from a sheet of material such as corrugated boxboard are often used to package heavy or fragile articles which require greater protection than that afforded by a single thickness of the sheet material. Therefore, various intricate formations and arrangements of the sheet material blank and inserts have been used in forming the box. In the alternative dunnage, styrofoam fillers and the like have been employed to provide cushioned or reinforced corners or ends on the box. Typical of such constructions are those shown and described in U.S. Pat. Nos. 2,581,400; 2,588,377; 3,162,350; 3,250,455, and 3,722,668. However, such constructions have employed blanks or irregular shape or additional inserts which when produced give rise to considerable waste material that increases the cost of the boxes formed therefrom and further call for difficult manipulations and expensive operations in fabricating a box from the blank produced.

In accordance with the present invention, a box having projecting reinforcing elements at the corners thereof, is produced so as to protect the contents of the box and cushion impacts at the corners thereof to which the box may be subjected. However, the novel construction is produced very easily from a single, unitary rectangular blank of sheet material with a minimum of labor and operations whereby the cost of producing the box is reduced very considerably.

SUMMARY OF THE INVENTION

Figure 1:
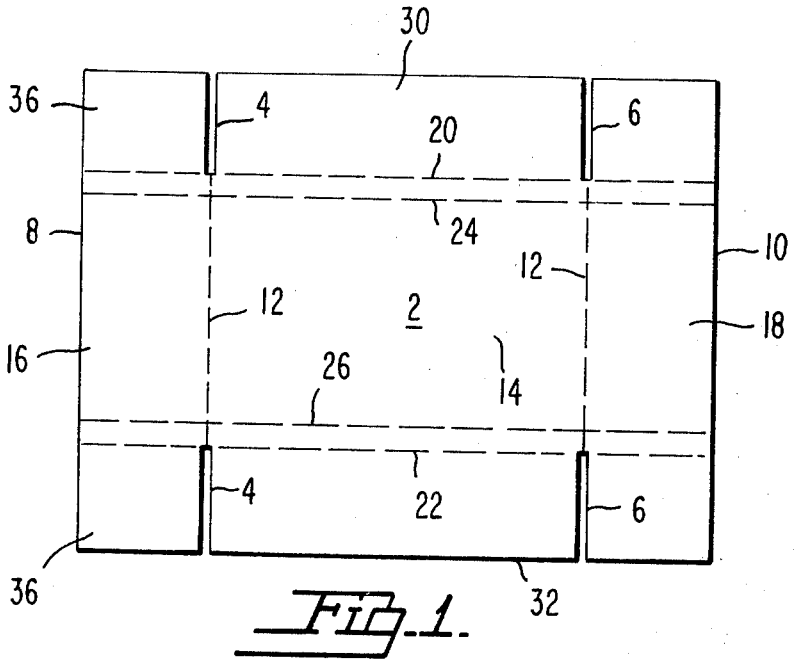
FIG. 1 is a plan view of a typical blank sheet adapted for use in producing a box in accordance with the present invention.

In that form of the invention chosen for purposes of illustration in the drawing, the blank 2 is formed of a single flat sheet of material such as corrugated box board and is generally rectangular in shape. Two pairs of aligned slots 4 and 6 are formed in the blank and are spaced from the adjacent ends 8 and 10 respectively of the blank a distance substantially equal to the depth of the box to be produced. A first score line 12 is formed in the sheet extending from the end of one of the alined slots to the end of the other slot of the pair. In this way the slots and score line define the joint between the central base 14 of the box and the sides 16 and 18 of the finished box.

The blank is further provided with second score lines 20 and 22 which extend the full length of the blank parallel to the opposite edges thereof in position to intersect the inner ends of the slots 4 and 6. Fold lines 24 and 26, which also may be scored, extend parallel to the second score lines 20 and 22 and are spaced therefrom a distance corresponding to the length of projection of the corners 28 desired in the finished box.

Figure 2:
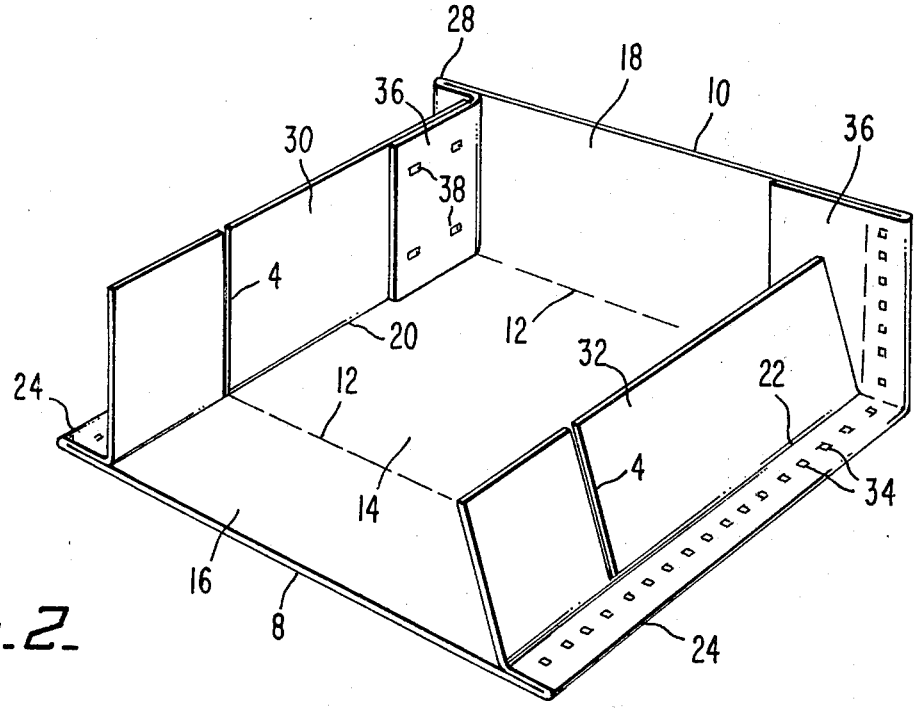
FIG. 2 is a perspective illustrating a first step in forming the blank of FIG. 1 into a box.
Figure 3:
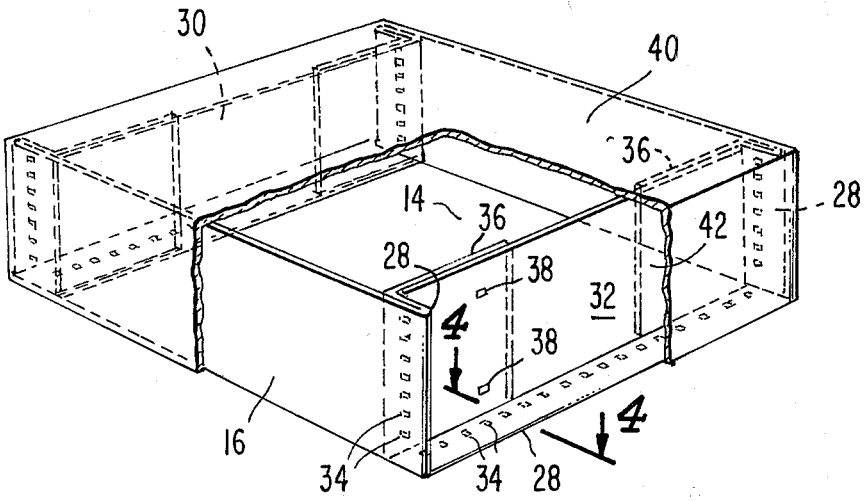
FIG. 3 is a perspective showing a finished box with a cover thereon in accordance with the present invention, the cover being broken away.
Figure 4:
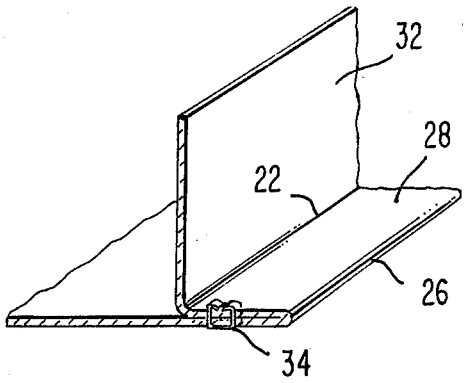
FIG. 4 is a sectional view taken on the line 4—4 of FIG. 3.

In forming the box from the blank shown in FIG. 1, the end portions 30 and 32 of the blank are folded inward as shown in FIGS. 2 and 4 along the fold lines 24 and 26 so as to overlie the base 14 and are secured to the base by suitable fastening means such as glue or the staples 34. The side portions 16 and 18 are then moved to vertical positions along the score lines 12 and the corner flaps 36 of the side portions 16 and 18 beyond slots 4 and 6 of the blank are turned inward to lie on the inner surface of the raised end portions 30 and 32. The flaps 36 are then secured to the end portions by means of glue, or fastening means such as staples 38 or the like to hold the sides and ends of the box in place.

The box thus produced has the corners 28 at the ends of the box projecting outward from the ends 30 and 32 about the bottom and both sides of the box so as to assure the desired reinforcement and rigidity of the box by reason of the doubled thickness of the sheet material and the stiffness resulting from its edgewise positioning at the corners thereof. Impacts on the corners of the box are thereby absorbed by the outwardly extending projections of double thickness boxboard. Moreover, the spacing of the end portions 30 and 32 inward from the plane of contact of the projections 28 with any surface or obstruction engaged by the projection serves further to prevent injury to the box and its contents. The regular rectangular outline of the box also renders it possible to apply a conventional cover 40 to the box so as to extend downward about the sides and ends of the box for added protection by the double walls and hollow spaces 42 at the ends of the box.

The construction thus provided embodies a single unitary flat sheet which is extremely simple and economical to produce since it requires a minimum of forming dies and little if any loss of material in producing the blanks required. At the same time the operations necessary to produce a box from the blank are extremely simple and lend themselves to automatic and very rapid fabrication steps. Moreover, the construction may be employed in producing boxes of widely varying sizes and shapes for receiving shipping, and handling very heavy or fragile objects without the addition of dunnage or filling material to protect the contents of the box.

In view thereof, it will be apparent that the particular embodiment of the invention shown in the drawing and described above is intended to be illustrative only and is not intended to limit the scope of the invention.

I claim:

1. A rectangular box having reinforced corners at the opposite ends thereof, said box formed of a rectangular sheet of material which serves as the base of the box, said sheet being provided with opposite end portions each having a section thereof folded inward into overlying relation with respect to said base and secured to said base, said end portions further extending upward from the inwardly folded sections and being of double thickness and projecting outwardly beyond said ends, said sheet having opposite side portions extending upward from the base to form the sides of the box, said side portions having extensions thereon secured to the upwardly extending end portions of the sheet to hold the sides and ends of the box in place.

2. In combination with a box as defined in claim 1, a cover conforming in shape to the box and extending downward about the outwardly projecting folded sections of the end portions of the box.

3. A rectangular box as defined in claim 1 wherein said folded sections of the end portion of the sheet are secured to the base by staples.

4. A blank for use in forming a box having reinforced ends comprising a rectangular sheet of material having a pair of aligned slots extending inward from opposite edges of the sheet a distance substantially equal to the depth of the box to be produced, a first score line extending between the ends of said slots, a second score line extending from end to end of said blank intersecting the inner ends of said slots, and a fold line extending parallel to said second score line and spaced inward therefrom.

5. A blank as described in claim 1 wherein said score lines are formed in opposite surfaces of said sheet.

* * * * *

UNITED STATES PATENT AND TRADEMARK OFFICE

CERTIFICATE OF CORRECTION

PATENT NO. : 3,986,657

DATED : October 19, 1976

INVENTOR(S) : Carl A. Angelini

It is certified that error appears in the above-identified patent and that said Letters Patent are hereby corrected as shown below:

Claim 5, line 1, change "1" to -- 4 --.

Signed and Sealed this

Twenty-second Day of February 1977

[SEAL]

*Attest:*

RUTH C. MASON
*Attesting Officer*

C. MARSHALL DANN
*Commissioner of Patents and Trademarks*